US006558073B1

(12) United States Patent
Wrazidlo

(10) Patent No.: US 6,558,073 B1
(45) Date of Patent: May 6, 2003

(54) PORTABLE, OSCILLATING GRADE DETERMINANT APPARATUS INCORPORATING LASER SIGNAL RECEIVER

(76) Inventor: Joseph D. Wrazidlo, 141 W. Wabasha St., Duluth, MN (US) 55803

( * ) Notice: Subject to any disclaimer, the term of this patent is extended or adjusted under 35 U.S.C. 154(b) by 32 days.

(21) Appl. No.: 10/003,993

(22) Filed: Nov. 2, 2001

(51) Int. Cl.[7] ..... E01C 19/30
(52) U.S. Cl. ..... 404/133.05; 404/84.5
(58) Field of Search ..... 404/133.05, 133.1, 404/84.05, 84.1, 84.5

(56) References Cited

U.S. PATENT DOCUMENTS 4,655,633 A 4/1987 Somero et al.
4,752,156 A * 6/1988 Owens ..... 404/118
4,930,935 A 6/1990 Quenzi et al.
5,288,166 A 2/1994 Allen et al.
5,328,295 A 7/1994 Allen
5,857,408 A * 1/1999 Witter ..... 100/265
6,089,787 A 7/2000 Allen et al.
6,129,481 A 10/2000 Tapio et al.
6,139,217 A * 10/2000 Reuter ..... 404/97
6,152,647 A 11/2000 Tapio et al.
6,183,160 B1 2/2001 Tapio et al.

* cited by examiner

*Primary Examiner*—Robert E. Pezzuto
*Assistant Examiner*—Raymond W. Addie
(74) *Attorney, Agent, or Firm*—John D. Gugliotta; P. Jeff Martin

(57) ABSTRACT

A portable, oscillating grade determinant apparatus incorporating laser signal receiver is provided for determining proper cement elevation or slope. The apparatus has an electric motor, powered by a rechargeable battery, and actuated by a depressible switch, which turns a metal plate that is unbalanced by the removal of a pie-shaped section therefrom. This unbalanced nature produces an oscillating motion which forces a tamping plate down into freshly-poured concrete. A laser receiver receives a laser signal from a separate laser transmitter mounted on a tripod. The laser receiver includes a speaker which generates audible beeps to indicate the concrete is at proper elevation.

16 Claims, 4 Drawing Sheets

PORTABLE, OSCILLATING GRADE DETERMINANT APPARATUS INCORPORATING LASER SIGNAL RECEIVER

RELATED APPLICATIONS

The present invention was first described in Disclosure Document No. 491,345 filed on Mar. 20, 2001. There are no previously filed, nor currently any co-pending applications, anywhere in the world.

BACKGROUND OF THE INVENTION

1. Field of the Invention

The present invention relates generally to concrete screeds and, more particularly, to a portable, oscillating grade determinant apparatus incorporating laser signal receiver.

2. Description of the Related Art

As anyone who performs a lot of physical work will attest, nothing beats having the proper tool for a job. The proper tool can save time, save money, produce a higher quality job, reduce damage to equipment, and provide for the increased safety of the worker. Each field of physical work has its own type of specialty tools, each performing a specialized task. The field of concrete finishing is no different. Screed pipes and boards are used to get the wet concrete to the proper elevation. These screed devices are often used with a tripod-mounted laser transmitter to determine when the proper elevation is reached. However, this system relies on tamping down the concrete, checking the elevation, tamping again, then checking again in a trial and error process. Of course if one goes too far, more concrete must be added. This process, while functional, takes a great deal of time, which translates into lost revenue for the professional contractor.

Accordingly, there is a need for a means by which concrete can be finished in an accurate manner which is quick, easy and effective. The development of the portable, oscillating grade determinant apparatus incorporating laser signal receiver fulfills this need.

A search of the prior art did not disclose any patents that read directly on the claims of the instant invention; however, the following references were considered related. The following patents disclose a screeding apparatus and method incorporating an oscillating attachment: U.S. Pat. No. 6,183,160 issued in the name of Tapio et al.; and U.S. Pat. No. 6,152,647 issued in the name of Tapio et al.

The following patents describe a laser-guided portable screed: U.S. Pat. No. 5,288,166 issued in the name of Allen et al.; and U.S. Pat. No. 4,4,752,156 issued in the name of Owens.

U.S. Pat. No. 6,129,481 issued in the name of Tapio et al. discloses a screed assembly and oscillating member kit therefor.

U.S. Pat. No. 6,089,787 issued in the name of Allen et al. describes a transformable two-person floating screed with automatic grade control.

U.S. Pat. No. 5,328,295 issued in the name of Allen discloses a torsional automatic grade control system for concrete finishing.

U.S. Pat. No. 4,930,935 issued in the name of Quenzi et al. describes an apparatus and method for pivoting a screed assembly.

U.S. Pat. No. 4,655,633 issued in the name of Somero et al. describes a self-propelled screeding apparatus and method.

Consequently, a need has been felt for providing a device which allows for the finishing of concrete in a manner which ensures floors are at the correct slope or completely level with a minimal amount of effort and time, which translates into increased revenue for the concrete contractor.

SUMMARY OF THE INVENTION

Therefore, it is an object of the present invention to provide a concrete grade determinant device which aids in the finishing of concrete.

It is another object of the present invention to provide a concrete grade determinant device which replaces the use of screed pipes or lumber.

It is still another object of the present invention to provide a concrete grade determinant device which works faster than conventional methods and which saves time and money.

It is still another object of the present invention to provide a concrete grade determinant device which provides a one shot operation, thus alleviating trial and error.

It is another object of the present invention to provide a tamping plate which forces concrete down to the proper level.

It is another object of the present invention to provide a tamping plate which is located at the base of the invention.

It is another object of the present invention to provide a metal plate with a triangular void which is rotated by an electric motor.

It is another object of the present invention to provide a metal plate with a triangular void which produces an oscillating or vibrating motion.

It is another object of the present invention to provide an electric motor powered by rechargeable batteries.

It is another object of the present invention to provide an electric motor controlled by a depressible ON/OFF switch.

It is another object of the present invention to provide a laser receiver located at the top of the present invention which operates in a conventional manner.

It is another object of the present invention to provide a laser receiver which receives signals from a conventional rotating laser transmitter mounted on a tripod.

It is another object of the present invention to provide a laser receiver having a speaker for generating an audible beeping sound when proper elevation is reached.

Briefly described according to one embodiment of the present invention, a portable, oscillating grade determining apparatus incorporating laser signal receiver is provided to aid in the installation and leveling of poured concrete floors. The present invention is placed upon poured concrete and activated via a depressible ON/OFF switch. An electric motor, powered by a rechargeable battery pack, turns a metal plate that is unbalanced by the removal of a pie-shaped section therefrom. This unbalanced nature produces an oscillating motion, which forces the tamping plate down into the wet concrete. Finally, when a laser receiver located at the top of the present invention receives a laser signal from a separate but conventional laser transmitter mounted on a tripod, the laser receiver beeps, indicating the concrete is now at the proper elevation. At this point, the present invention is removed and the remainder of the concrete can be finished to the same elevation.

The use of the present invention allows for the finishing of concrete in a manner which ensures floors are at the correct slope or completely level with a minimal amount of effort and time, which translates into increased revenue for the concrete contractor.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
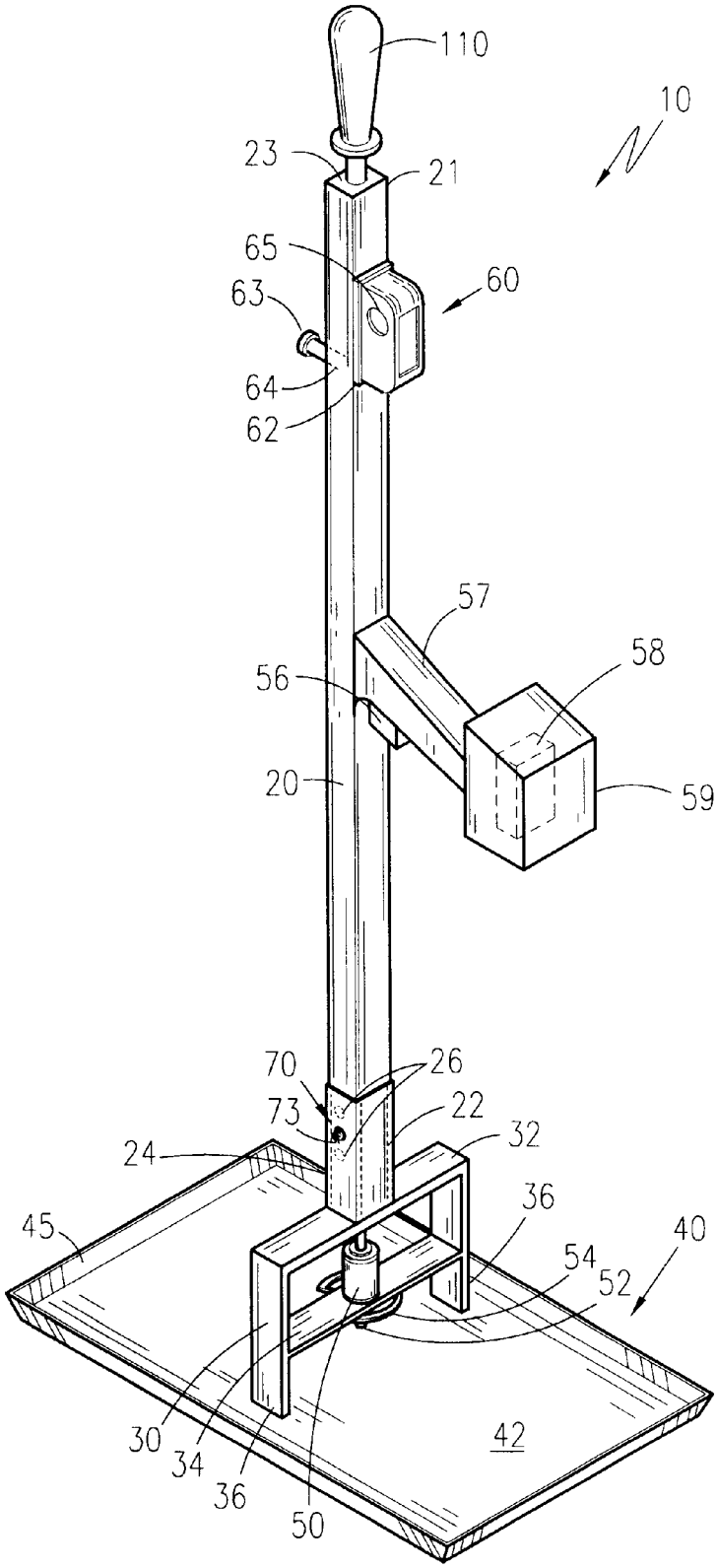
FIG. 1 is a perspective view of a portable, oscillating grade determinant apparatus incorporating laser signal receiver according to the preferred embodiment of the present invention.
Figure 2:
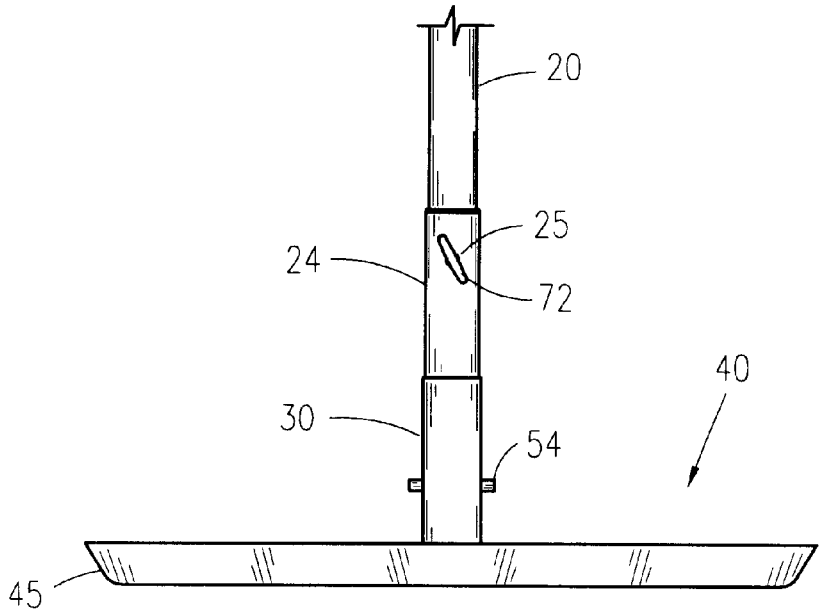
FIG. 2 is a partial right-side elevational view of the portable, oscillating grade determinant apparatus incorporating laser signal receiver according to the preferred embodiment of the present invention.
Figure 3:
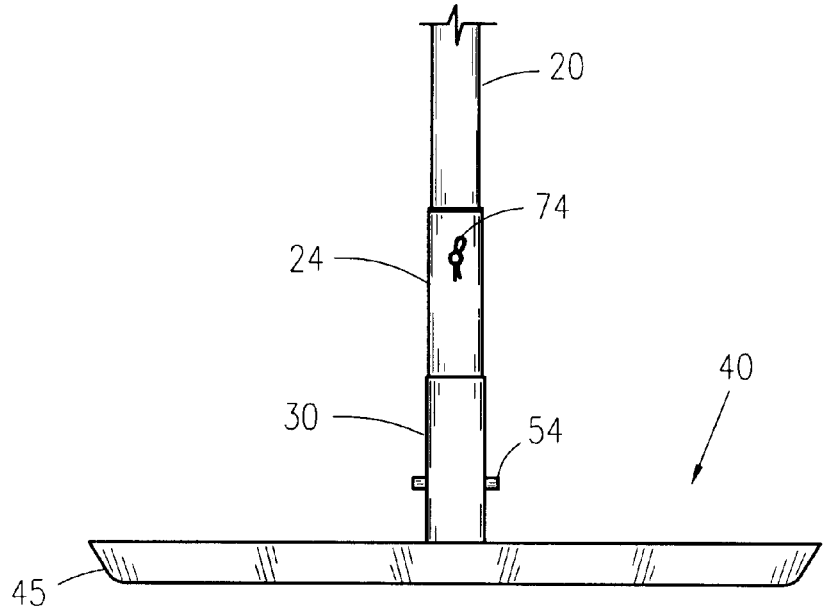
FIG. 3 is a partial left-side elevational view thereof.
Figure 4:
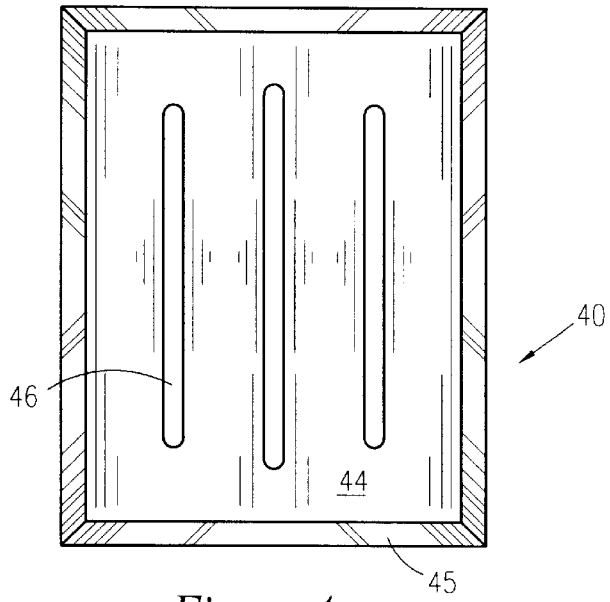
FIG. 4 is a bottom side view of the tamping plate according to the preferred embodiment of the present invention.
Figure 5:
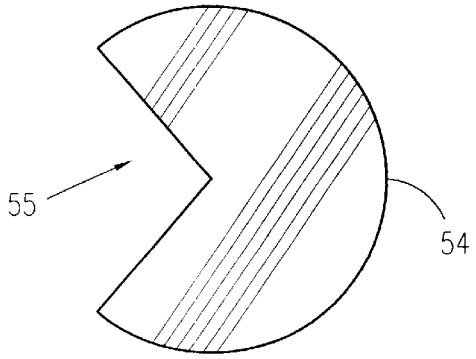
FIG. 5 is a bottom side view of the metal plate according to the preferred embodiment of the present invention.
Figure 6:
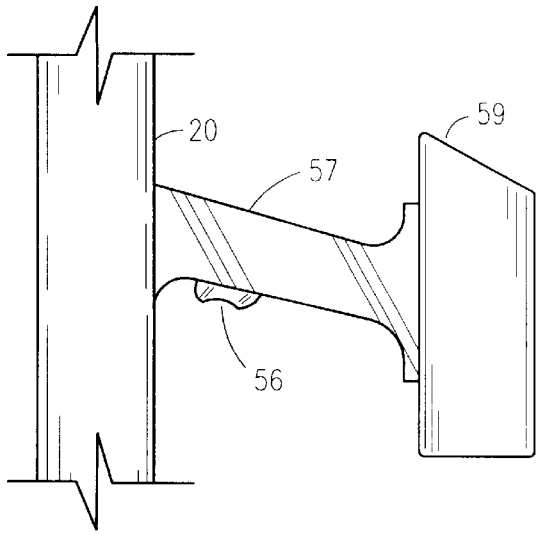
FIG. 6 is side elevational view of the handle and battery housing according to the preferred embodiment of the present invention.

Referring now to FIGS. 1–4, a portable, oscillating grade determinant apparatus incorporating laser signal receiver 10 is shown, according to the present invention, comprised of an elongated grade post 20, an A-shaped base bracket 30, a tamping plate 40, an electric motor 50, and a laser signal receiver 60.

The grade post 20 is of an elongated, hollow, rectangular configuration telescopically received within a grade post receiving member 24. The grade post receiving member 24 is of an elongated, hollow, rectangular configuration welded perpendicularly to an upper tier 32 of the A-shaped base bracket 30 (to be described in greater detail below). A posterior end 22 of the grade post 20 telescopes inside the grade post receiving member 24, and is held in a desired vertical position via a pin assembly 70.

The pin assembly 70 includes a removable, handled pin 72 designed so as to cooperate with a plurality of holes 26 vertically aligned along the posterior end 22 of the grade post 20. The handled pin 72 is shown located along an outer sidewall of the grade post receiving member 24, positioned laterally, and extends through a hole 25 formed therein. The handled pin 72 is designed so as to cooperate with a desired plurality of holes 26 formed in the grade post 20, thus providing a grade post 20 having various vertical lengths. Once a desired vertical length has been chosen, the grade post 20 is held in such position via a clamping pin 74 inserted through a hole 73 formed within an end of the handled pin 72. The grade post 20 and the grade post receiving member 24 are preferably fabricated of an aluminum metal material.

The A-shaped base bracket 30 is fabricated preferably of an aluminum metal material and includes a middle tier 34 for supporting a 12 volt electric motor 50 suitably mounted thereto.

The A-shaped base bracket 30 has a pair of legs 36 perpendicularly welded centrally to an upper surface 42 of the tamping plate 40. The tamping plate 40 is of a generally rectangular configuration having an angularly-oriented, raised lip 45 defining a periphery thereof. The tamping plate 40 has a lower surface 44 with a plurality of elongated ridges 46 welded perpendicularly in a series thereto. The ridges 46 serve to provide some degree of cohesion between the lower surface 44 of the tamping plate 40 and freshly-poured concrete 100 during operation of the present invention. The tamping plate 40 is preferably fabricated of an aluminum metal material.

Referring now to FIGS. 1, 2, 3, 5, and 6, rotatably mounted in a perpendicular fashion via a drive arm 52 to the electric motor 50 is a metal plate 54. The metal plate 54 is designed with a triangular void 55 formed therein, whereupon actuation of electric motor 50 facilitates oscillatory rotation by the metal plate 54. Actuation of the electric motor 50 is controlled by a depressible ON/OFF switch 56, electrically connected thereto, mounted along a lower external sidewall of a generally rectangular, elongated handle 57. The handle 57 is perpendicularly mounted along a linearly elongated centerline of the external sidewall of the grade post 20. The handle 57 facilitates ease in transportability of the present invention. The electric motor 50 is powered by a rechargeable battery 58. The rechargeable battery 58 resides within a square-shaped battery housing 59 mounted to an outward end of the handle 57.

Figure 7:
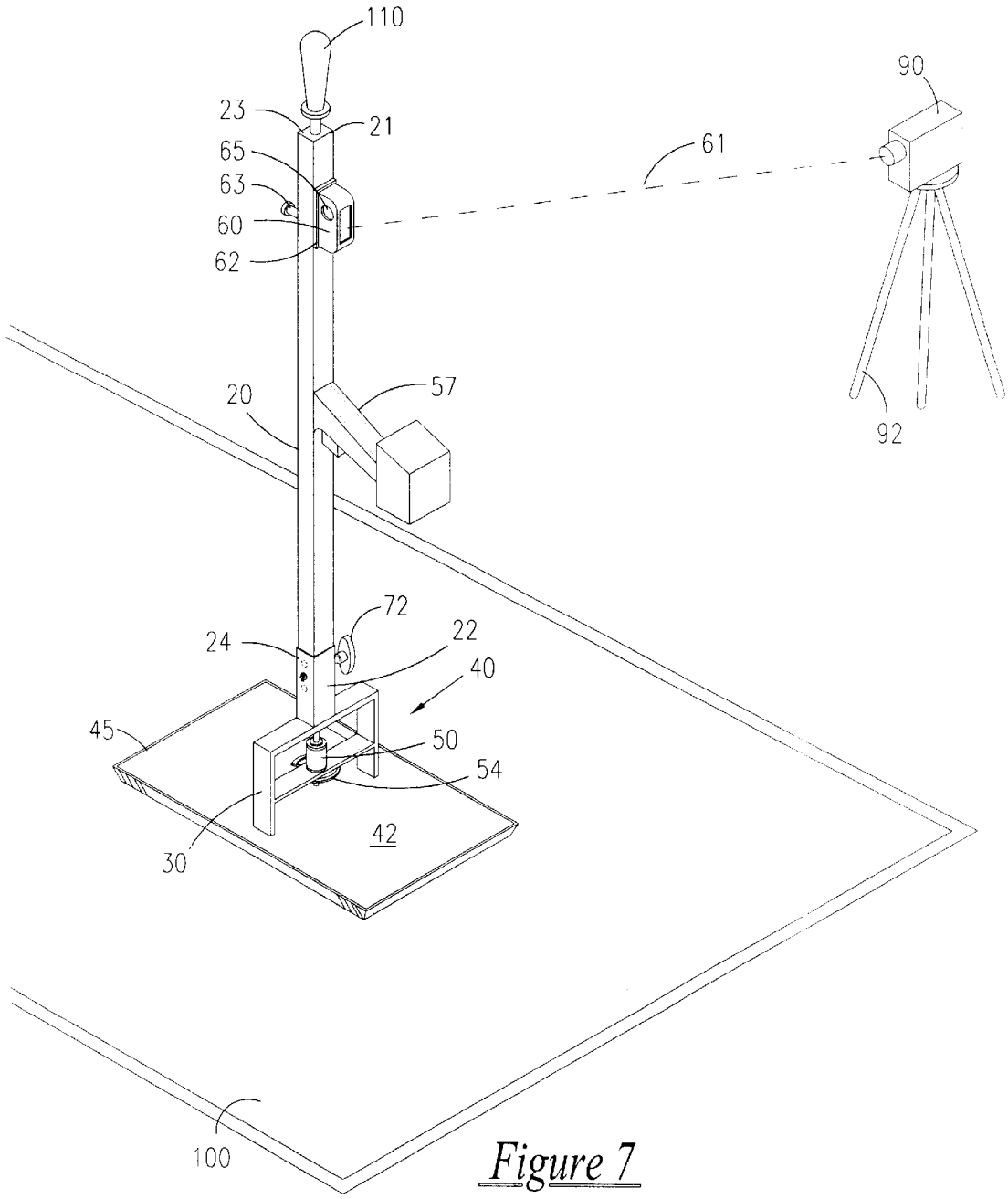
FIG. 7 is a perspective view of the portable, oscillating grade determinant apparatus incorporating laser signal receiver shown in-use.

Referring now to FIGS. 1 and 7, the laser signal receiver 60 is adapted for receiving laser leveling signals 61 produced by a separate laser transmitter 90. The laser signal receiver 60 is suitably attached to a rectangular bracket 62 mounted for vertical movement to the grade post 20 above the handle 57. In order to secure the rectangular bracket 62 to the grade post 20, a thumb screw 63 is threadedly engaged within a threaded bore 64 of the rectangular bracket 62 until reaching the external sidewall of the grade post 20, thus allowing for various vertical orientations of the rectangular bracket 62. The laser transmitter 90 is suitably mounted on a tripod 92 and produces a planar leveling signal throughout an angular reference plane, thus requiring the need for only a single laser signal receiver 60.

In use, the laser transmitter 90 is placed in a desired location and laser leveling signals 61 are generated therefrom. The portable, oscillating grade determinant apparatus incorporating laser signal receiver 10 is placed upon freshly-poured concrete 100, and the electric motor 50 is turned on via the depressible ON/OFF switch 56. The metal plate 54 rotates in a vibratory manner so as to produce an oscillating motion which forces the tamping plate 40 downward into the freshly-poured concrete 100. Upon laser signal receiver's 60 reception of laser leveling signals 61 transmitted by the laser transmitter 90, an audible beeping sound is generated from a speaker 65 located on the laser signal receiver 60, thus indicating the freshly-poured concrete 100 is at proper elevation. At this point, the portable, oscillating grade determinant apparatus incorporating laser signal receiver 10 is removed from the area of freshly poured concrete 100 and the remaining concrete is screeded to the previously determined elevation. The present invention provides a means for determining proper cement elevation in a single attempt, thus alleviating any trial and error process previously required for rechecking elevation levels.

Therefore, provided that the laser transmitter 90 remains stationary so as to transmit laser leveling signals 61 being transmitted in a precisely level reference plane, freshly poured concrete 100 can be screeded in a manner which ensures a completely level surface.

2. Operation of the Preferred Embodiment

To use the present invention, the user places the laser transmitter 90 in a desired location for generating laser leveling signals 61. The user then places the portable, oscillating grade determinant apparatus incorporating laser signal receiver 10 upon an area of freshly-poured concrete 100, and turns the electric motor 50 on via the depressible ON/OFF switch 56, thereby actuating rotation by the metal plate 54 in a vibratory manner so as to produce an oscillating motion which forces the tamping plate 40 downward into the freshly-poured concrete 100. Upon laser signal receiver's 60 reception of laser leveling signals 61 being transmitted by the laser transmitter 90, an audible beeping sound is generated from the speaker 65 which indicates the freshly-poured concrete 100 is at proper elevation. At this point, the user removes the portable, oscillating grade determinant apparatus incorporating laser signal receiver 10 from the area of freshly poured concrete 100 and screeds the remaining concrete to the previously determined elevation.

The use of the present invention allows for the finishing of concrete in a manner which ensures floors are: at the correct slope or completely level with a minimal amount of effort and time, which translates into increased revenue for the concrete contractor.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A portable, oscillating grade determinant apparatus incorporating laser signal receiver comprising:

a grade post, said grade post is of an elongated, hollow, rectangular configuration fabricated of an aluminum metal material and telescopically received within a grade post receiving member;

a base bracket, said base bracket is of an A-shaped configuration having an upper tier and a middle tier, and wherein said base bracket is fabricated of an aluminum metal material;

a tamping plate, said tamping plate is of a generally rectangular configuration fabricated of an aluminum metal material and has an angularly-oriented, raised lip defining a periphery of said tamping plate;

an electric motor;

a laser signal receiver, said laser signal receiver is adapted for receiving laser leveling signals produced by a separate laser transmitter; and a pin assembly.

2. The portable, oscillating grade determinant apparatus incorporating laser signal receiver of claim 1, wherein said grade post has a posterior end which telescopes inside said grade post receiving member, and is held in a desired vertical position via said pin assembly.

3. The portable, oscillating grade determinant apparatus incorporating laser signal receiver of claim 1, wherein said grade post receiving member is of an elongated, hollow, rectangular configuration fabricated of an aluminum metal material welded perpendicularly to said upper tier of said base bracket.

4. The portable, oscillating grade determinant apparatus incorporating laser signal receiver of claim 1, wherein said pin assembly includes a removable, handled pin for cooperating with a plurality of holes vertically aligned along said posterior end of said grade post, said handled pin is positioned laterally along an outer sidewall of said grade post receiving member and extends through a hole formed in said grade post receiving member, wherein said pin assembly thus allows for various vertical lengths of said grade post.

5. The portable, oscillating grade determinant apparatus incorporating laser signal receiver of claim 1, where in said tamping plate includes an upper surface opposite a lower surface, wherein said lower surface has a plurality of elongated ridges welded perpendicularly in a series, said ridges serve to provide some degree of cohesion between said lower surface of said tamping plate and freshly-poured concrete during operation.

6. The portable, oscillating grade determinant apparatus incorporating laser signal receiver of claim 1, wherein said base bracket has a pair of legs perpendicularly welded centrally to said upper surface of said tamping plate.

7. The portable, oscillating grade determinant apparatus incorporating laser signal receiver of claim 1, wherein said electric motor has a metal plate rotatably mounted to said electric motor in a perpendicular fashion via a drive arm, said metal plate has a triangular void formed in said metal plate, whereupon actuation of said electric motor facilitates oscillatory rotation by said metal plate.

8. The portable, oscillating grade determinant apparatus incorporating laser signal receiver of claim 1, wherein said grade post includes a handle of a generally rectangular, elongated configuration perpendicularly mounted along a linearly elongated centerline of an external sidewall of said grade post.

9. The portable, oscillating grade determinant apparatus incorporating laser signal receiver of claim 8, wherein said handle includes a depressible switch for controlling actuation of said electric motor to an on position and an off position, wherein said depressible switch is electrically connected to said electric motor, and said depressible switch is mounted along a lower external sidewall of said handle.

10. The portable, oscillating grade determinant apparatus incorporating laser signal receiver of claim 9, wherein said electric motor is powered by a rechargeable battery, and wherein said rechargeable battery resides within a square-shaped battery housing mounted to an outward end of said handle.

11. The portable, oscillating grade determinant apparatus incorporating laser signal receiver of claim 1, wherein said laser signal receiver is suitably attached to a rectangular bracket mounted for vertical movement to said grade post above said handle.

12. The portable, oscillating grade determinant apparatus incorporating laser signal receiver of claim 11, wherein said rectangular bracket is secured to said grade post via a thumb screw being threadedly engaged within a threaded bore of said rectangular bracket until reaching the external sidewall of said grade post, thereby allowing for various vertical orientations of said rectangular bracket.

13. The portable, oscillating grade determinant apparatus incorporating laser signal receiver of claim 1, wherein said separate laser transmitter is suitably mounted on a tripod, said separate laser transmitter produces a planar leveling signal throughout an angular reference plane, thus requiring the need for only a single said laser signal receiver.

14. The portable, oscillating grade determinant apparatus incorporating laser signal receiver of claim 7, wherein said metal plate rotates, via actuation of said electric motor, in a vibratory manner so as to produce an oscillating motion which forces said tamping plate downward into said freshly-poured concrete.

15. The portable, oscillating grade determinant apparatus incorporating laser signal receiver of claim 11, wherein said laser signal receiver receives laser leveling signals transmitted by said separate laser transmitter.

16. The portable, oscillating grade determinant apparatus incorporating laser signal receiver of claim 15, wherein said laser signal receiver has a speaker which generates an audible beeping sound when said freshly-poured concrete is at proper elevation.

* * * * *